US011398693B2

(12) United States Patent
Yang et al.

(10) Patent No.: US 11,398,693 B2
(45) Date of Patent: Jul. 26, 2022

(54) CARD EDGE CONNECTOR

(71) Applicant: CHIEF LAND ELECTRONIC CO., LTD., New Taipei (TW)

(72) Inventors: Yueh-Lin Yang, New Taipei (TW); Che-Ting Wu, New Taipei (TW); Guo-Cing Chen, New Taipei (TW)

(73) Assignee: CHIEF LAND ELECTRONIC CO., LTD., New Taipei (TW)

( * ) Notice: Subject to any disclaimer, the term of this patent is extended or adjusted under 35 U.S.C. 154(b) by 0 days.

(21) Appl. No.: 17/031,860

(22) Filed: Sep. 24, 2020

(65) Prior Publication Data

US 2021/0351529 A1 Nov. 11, 2021

(30) Foreign Application Priority Data

May 7, 2020 (TW) ..... 109205476

(51) Int. Cl.
*H01R 12/72* (2011.01)
*H01R 12/55* (2011.01)

(52) U.S. Cl.
CPC ..... *H01R 12/721* (2013.01); *H01R 12/55* (2013.01)

(58) Field of Classification Search
CPC ..... H01R 13/6461; H01R 13/6471; H01R 13/6473; H01R 13/6591; H01R 13/6597; H01R 13/6585; H01R 13/6599; H01R 12/55; H01R 12/721; H01R 12/724; H01R 12/727; H01R 12/57; H01R 12/735; H01R 12/732; H01R 12/737
USPC ..... 439/636, 94, 941
See application file for complete search history.

(56) References Cited

U.S. PATENT DOCUMENTS 8,702,451 B2 * 4/2014 Luo ..... H01R 12/725 439/607.28
8,764,488 B2 * 7/2014 Zeng ..... H01R 13/6471 439/626
9,281,589 B2 * 3/2016 Hsiao ..... H01R 4/04
9,337,585 B1 * 5/2016 Yang ..... H01R 13/6471
9,379,494 B1 * 6/2016 Hu ..... H01R 13/6594
9,455,530 B2 * 9/2016 Patel ..... H01R 13/6597
9,478,884 B2 * 10/2016 Tsai ..... H01R 12/724
9,531,130 B1 * 12/2016 Phillips ..... H01R 13/6471
9,640,915 B2 * 5/2017 Phillips ..... H01R 13/6471
9,660,399 B2 * 5/2017 Hsu ..... H01R 24/60
9,799,994 B2 * 10/2017 Chen ..... H01R 13/6585
(Continued)

*Primary Examiner* — Marcus E Harcum
(74) *Attorney, Agent, or Firm* — Li & Cai Intellectual Property Office

(57) ABSTRACT

A card edge connector is provided. The card edge connector includes an insulating housing, a terminal module, and a connection bridge. The insulating housing has an insertion surface and an assembling surface, and the insulating housing has an insertion slot recessed in the insertion surface and an accommodating slot that is recessed in the assembling surface. The terminal module includes two plastic cores restricted in position by being linearly slidable with each other and a plurality of conductive terminals that are respectively fixed by the two plastic cores so as to be arranged in two rows. The two plastic cores are received in the accommodating slot. The connection bridge is arranged between the two rows of the conductive terminals. The connection bridge has at least two elastic arms respectively abutted against at least two of the conductive terminals that are respectively fixed by the two plastic cores.

13 Claims, 8 Drawing Sheets

(56) References Cited

U.S. PATENT DOCUMENTS

| | | | | |
|---|---|---|---|---|
| 9,972,945 | B1 * | 5/2018 | Huang | H01R 24/60 |
| 10,050,369 | B1 * | 8/2018 | Yang | H01R 13/405 |
| 10,135,197 | B2 * | 11/2018 | Little | H01R 13/6585 |
| 10,224,674 | B1 * | 3/2019 | Huang | H01R 13/6471 |
| 10,367,308 | B2 * | 7/2019 | Little | H01R 13/6471 |
| 10,411,411 | B2 * | 9/2019 | Tang | H01R 13/6587 |
| 10,553,971 | B1 * | 2/2020 | Phillips | H01R 12/716 |
| 10,574,002 | B1 * | 2/2020 | Henry | H01R 13/6587 |
| 10,581,201 | B2 * | 3/2020 | Hsu | H01R 13/6585 |
| 10,581,206 | B2 * | 3/2020 | Fang | H01R 13/646 |
| 10,601,160 | B2 * | 3/2020 | Kao | G06F 13/409 |
| 10,756,489 | B2 * | 8/2020 | Hu | H01R 12/737 |
| 10,777,921 | B2 * | 9/2020 | Lu | H01R 12/82 |
| 10,847,936 | B2 * | 11/2020 | Tang | H01R 13/405 |
| 11,005,209 | B2 * | 5/2021 | Chen | H01R 13/02 |
| 11,056,834 | B2 * | 7/2021 | Casher | H01R 12/57 |
| 2012/0184145 | A1 * | 7/2012 | Zeng | H01R 13/6471 439/626 |
| 2015/0244111 | A1 * | 8/2015 | Ju | H01R 24/60 439/607.05 |
| 2015/0255904 | A1 * | 9/2015 | Ito | H01R 13/6471 439/88 |
| 2017/0077652 | A1 * | 3/2017 | Chen | H01R 24/60 |
| 2018/0294592 | A1 * | 10/2018 | Huang | H01R 12/721 |
| 2019/0131743 | A1 * | 5/2019 | Hsu | H01R 13/405 |
| 2020/0203867 | A1 * | 6/2020 | Lu | H01R 13/6581 |
| 2020/0212612 | A1 * | 7/2020 | Yang | H01R 12/775 |
| 2020/0212632 | A1 * | 7/2020 | Liong | H01R 12/716 |
| 2021/0075164 | A1 * | 3/2021 | Chen | H01R 13/2464 |
| 2021/0135389 | A1 * | 5/2021 | Jiang | H01R 13/405 |
| 2021/0194180 | A1 * | 6/2021 | Wang | H01R 13/405 |

* cited by examiner

CARD EDGE CONNECTOR

CROSS-REFERENCE TO RELATED PATENT APPLICATION

This application claims the benefit of priority to Taiwan Patent Application No. 109205476, filed on May 7, 2020. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a connector, and more particularly to a card edge connector.

BACKGROUND OF THE DISCLOSURE

A conventional card edge connector includes a plurality of conductive terminals arranged in two rows and two plastic cores that respectively fix the two rows of the conductive terminals in position. As the structure of the conventional card edge connector has tended to mature, the research and development personnel in this field have gradually ignored the structural improvement of the internal components (e.g., plastic cores) of the conventional card edge connector.

SUMMARY OF THE DISCLOSURE

In response to the above-referenced technical inadequacies, the present disclosure provides a card edge connector to effectively improve on the issues associated with conventional card edge connectors.

In one aspect, the present disclosure provides a card edge connector, which includes an insulating housing, a terminal module, and a connection bridge. The insulating housing includes an insertion surface and an assembling surface. The insulating housing has an insertion slot recessed in the insertion surface and an accommodating slot that is recessed in the assembling surface. The insertion slot is configured to accommodate an electronic card along a first direction. The terminal module includes two plastic cores and a plurality of conductive terminals that are respectively fixed by the two plastic cores so as to be arranged in two rows. The two plastic cores are restricted in position by being linearly slidable with each other along the first direction, and each of the two plastic cores is received in the accommodating slot of the insulating housing. The connection bridge is arranged between the two rows of the conductive terminals respectively fixed by the two plastic cores. The connection bridge has at least two elastic arms respectively abutted against at least two of the conductive terminals that are respectively fixed by the two plastic cores.

Therefore, by virtue of "the card edge connector" in the present disclosure, the two plastic cores are restricted in position by being linearly slidable with each other, and the two plastic cores are configured to be linearly slidable with each other along the first direction, so that the two plastic cores can be firmly assembled into the accommodating slot of the insulating housing.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
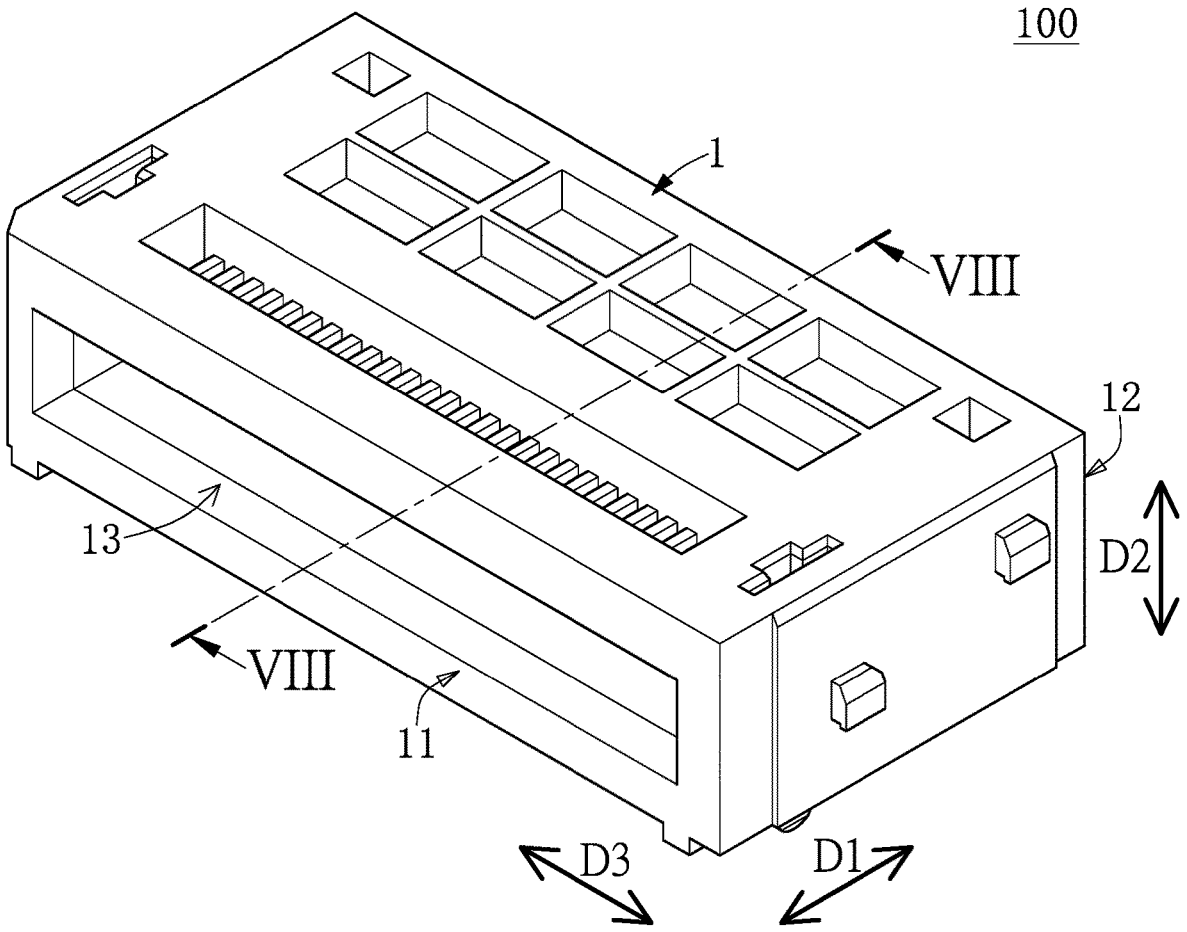
FIG. 1 is a perspective view of a card edge connector according to the present disclosure.
Figure 2:
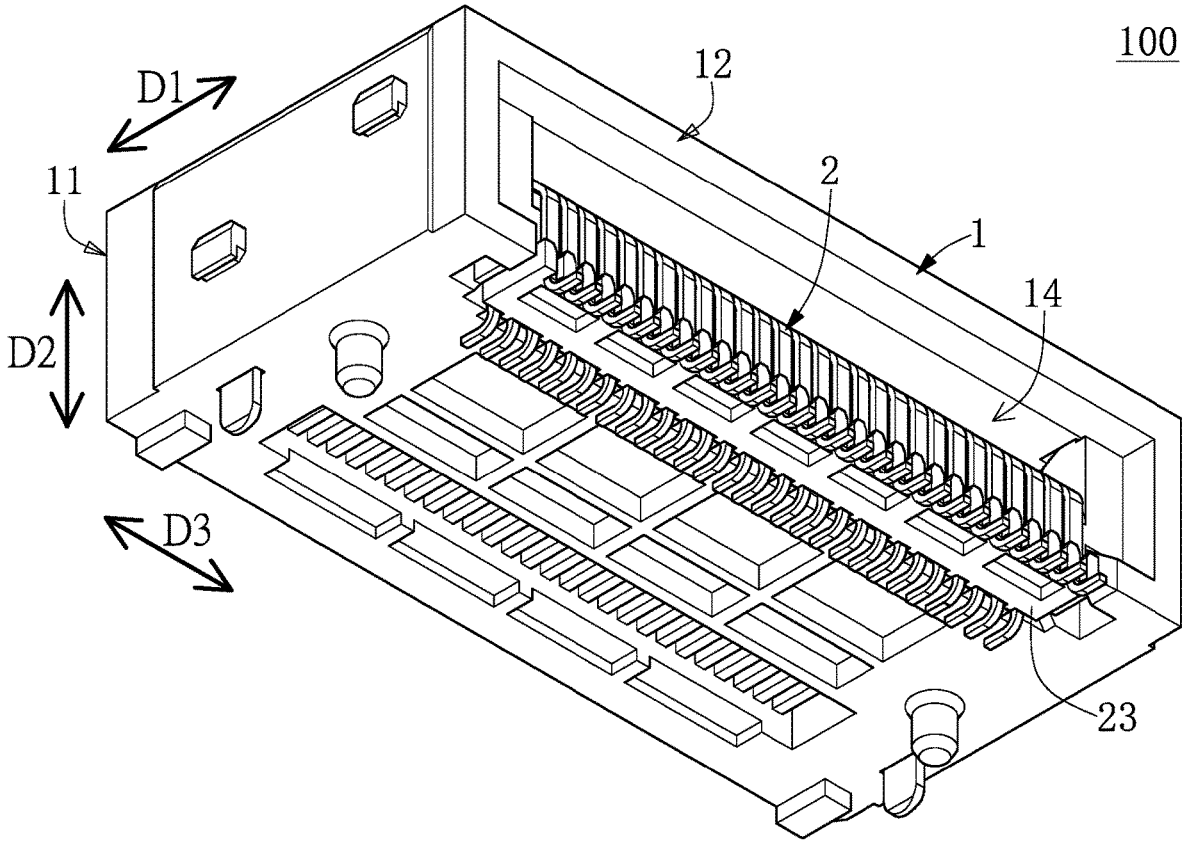
FIG. 2 is a perspective view of the card edge connector from another angle of view according to the present disclosure.
Figure 3:
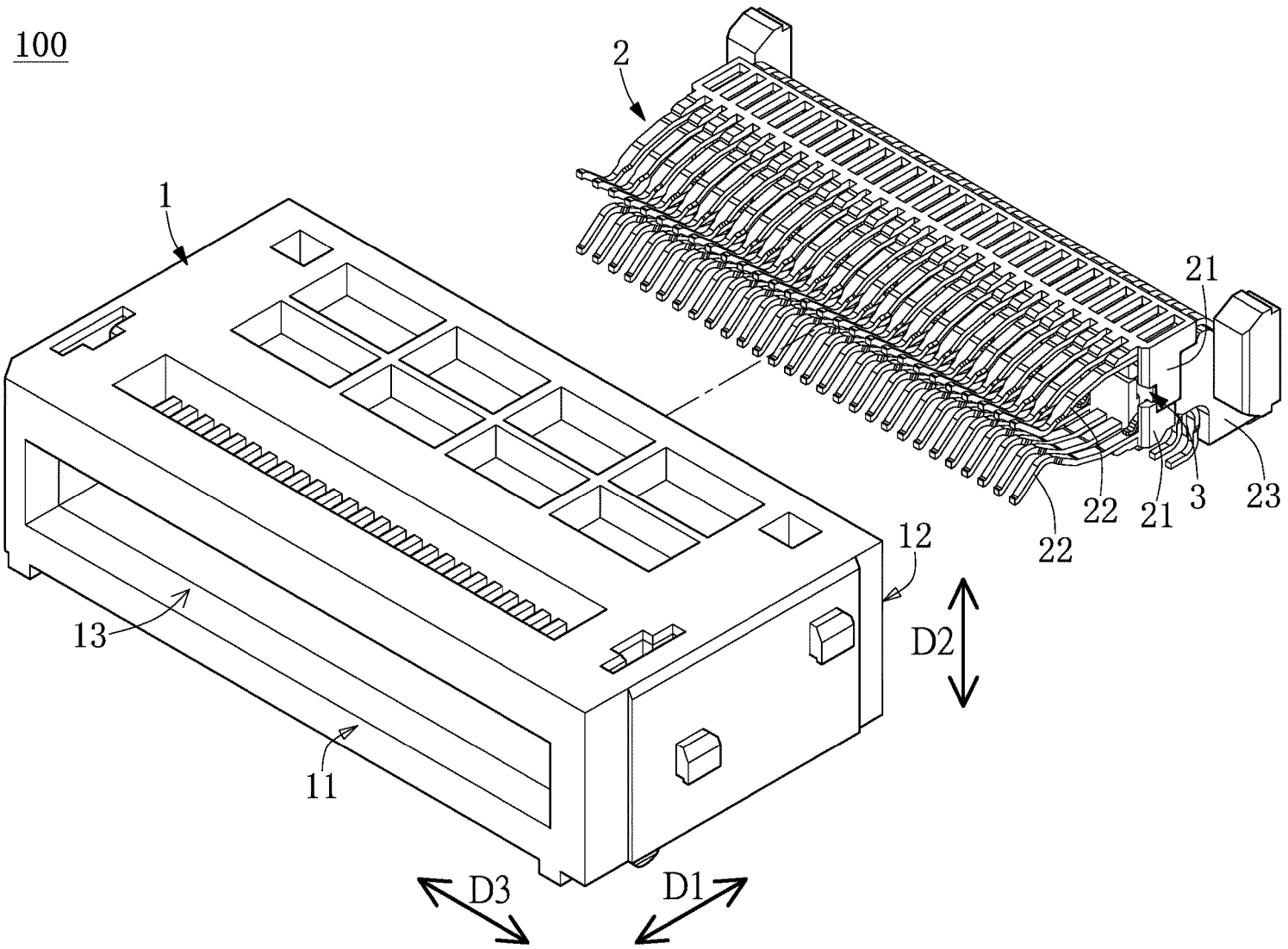
FIG. 3 is an exploded view of FIG. 1.
Figure 4:
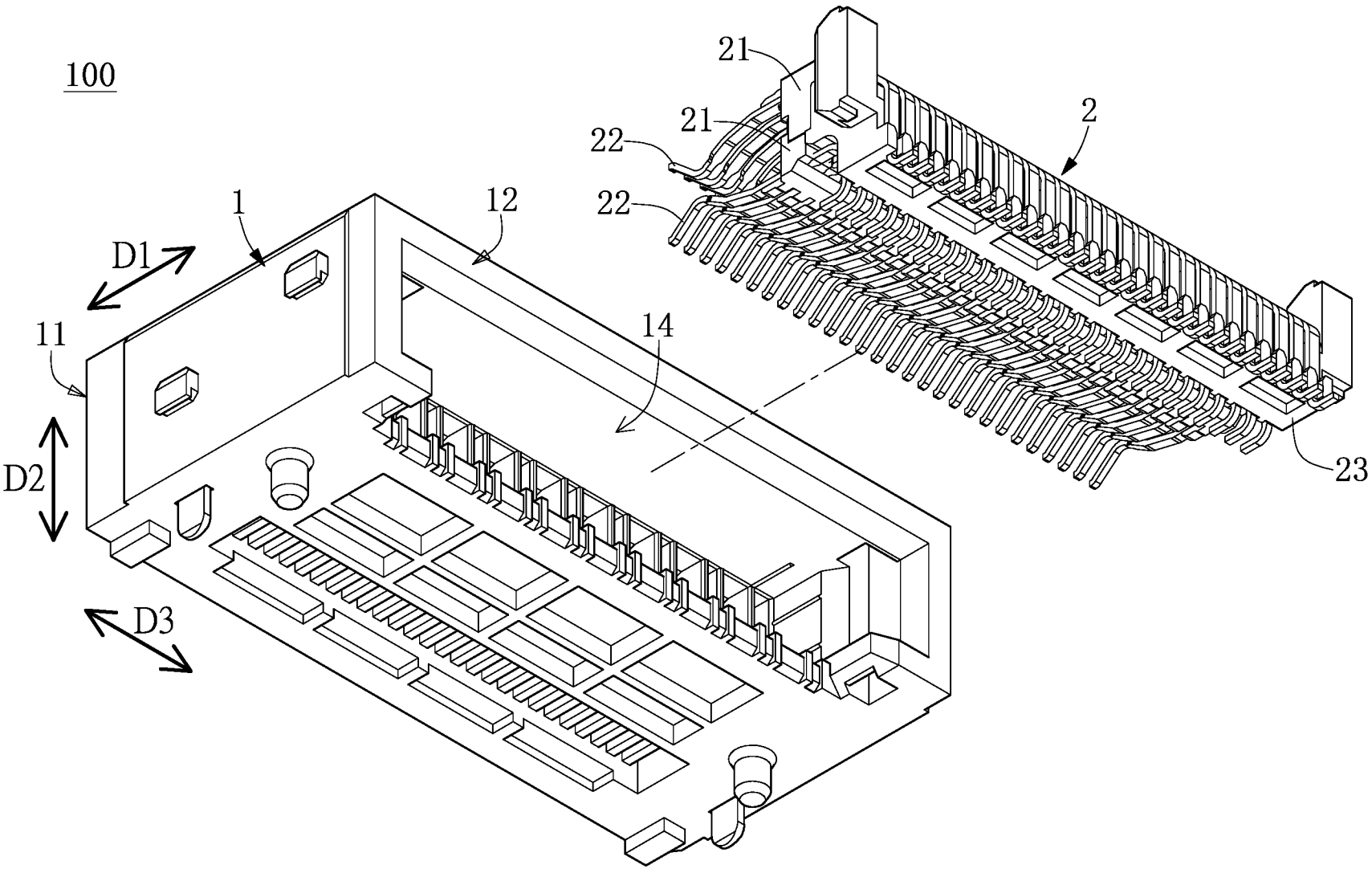
FIG. 4 is an exploded view of FIG. 2.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Referring to FIG. 1 to FIG. 8, an embodiment of the present disclosure provides a card edge connector 100 for being inserted with an electronic card (not shown in the figures) along a first direction D1. It should be noted that the card edge connector 100 in the present embodiment is a right angle connector, but the present disclosure is not limited thereto. For example, in other embodiments of the present disclosure, the card edge connector 100 can be a vertical connector by omitting the following terminal comb 23.

As shown in FIG. 1 to FIG. 4, the card edge connector 100 includes an insulating housing 1, a terminal module 2 assembled in the insulating housing 1, and a connection bridge 3 that is assembled to the terminal module 2. In order to clearly describe the structure and connection relationship of each component of the card edge connector 100, the card edge connector 100 further defines a second direction D2 and a third direction D3 that is perpendicular to the first direction D1 and the second direction D2, and the second direction D2 is perpendicular to the first direction D1.

The insulating housing 1 in the present embodiment is a substantial cuboid, and includes an insertion surface 11 and an assembling surface 12. The insertion surface 11 is arranged on one side of the insulating housing 1 that can be defined as a front side of the insulating housing 1 (as shown in FIG. 1). The insulating housing 1 has an insertion slot 13 that is recessed from the insertion surface 11 toward the assembling surface 12 along the first direction D1 and that is configured to accommodate the electronic card along the first direction D1. The assembling surface 12 is arranged on another side of the insulating housing 1 that can be defined as a rear side of the insulating housing 1 (as shown in FIG. 1). The insulating housing 1 has an accommodating slot 14 recessed from the assembling surface 12 toward the insertion surface 11 along the first direction D1, and the accommodating slot 14 is in spatial communication with the insertion slot 13.

As shown in FIG. 5 to FIG. 8, the terminal module 2 includes two plastic cores 21, a plurality of conductive terminals 22 respectively fixed by the two plastic cores 21 so as to be arranged in two rows, and a terminal comb 23 that is abutted against the two plastic cores 21. Each of the two plastic cores 21 has a plurality of troughs 211 each extending along the second direction D2. One of the two plastic cores 21 (e.g., the plastic core 21 shown in FIG. 5 located under the terminal comb 23) has a transverse groove 212 that is in spatial communication with the troughs 211. The transverse groove 212 in the present embodiment is parallel to the third direction D3.

Moreover, the two plastic cores 21 are restricted in position by being linearly slidable with each other, and the two plastic cores 21 are configured to linearly slidable with each other along the first direction D1. In the present embodiment, the two plastic cores 21 have a plurality of first dovetail slots 213 and a plurality of first dovetail tenons 214 that are in cooperation with the first dovetail slots 213. The first dovetail tenons 214 can be respectively inserted into the first dovetail slots 213 along the first direction D1. Therefore, the two plastic cores 21 are slidably assembled with each other along the first direction D1 by the first dovetail tenons 214 and the first dovetail slots 213. For example, each of the two plastic cores 21 has a plurality of first dovetail slots 213 and a plurality of first dovetail tenons 214, and the first dovetail slots 213 and the first dovetail tenons 214 of one of the two plastic cores 21 are in cooperation with the first dovetail tenons 214 and the first dovetail slots 213 of the other one of the two plastic cores 21. In addition, in other embodiments of the present disclosure, one of the two plastic cores 21 has a plurality of first dovetail slots 213, and the other one of two plastic cores 21 has a plurality of first dovetail tenons 214.

Figure 8:
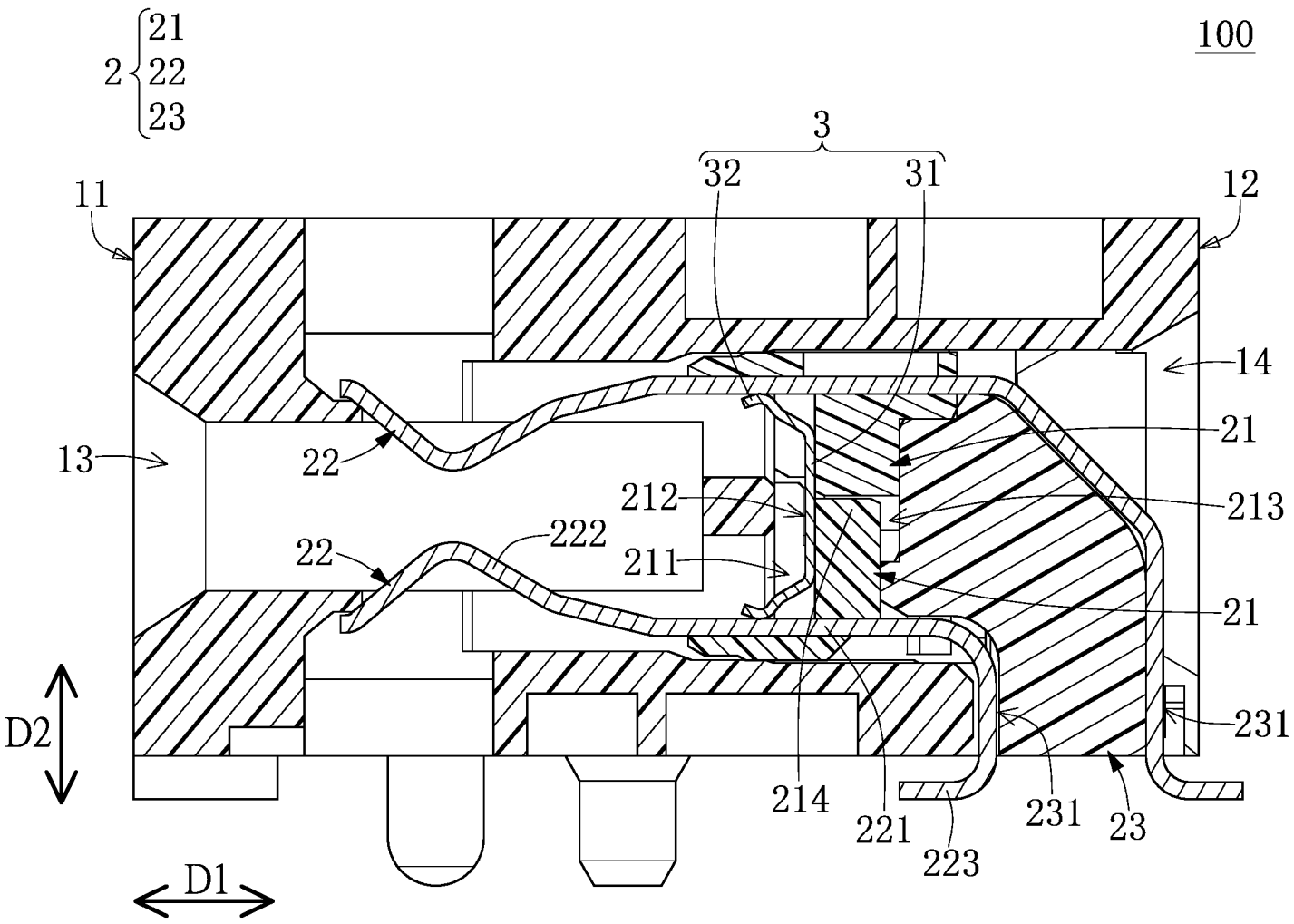
FIG. 8 is a cross-sectional view taken along line VIII-VIII of FIG. 1.

Specifically, when the two plastic cores 21 are assembled with each other, the first dovetail slots 213 and the first dovetail tenons 214 are arranged at one side of the transverse groove 212 away from the troughs 211 (e.g., the right side of the transverse groove 212 shown in FIG. 8).

Each of the conductive terminals 22 includes an embedded segment 221 embedded in the corresponding plastic core 21, a contact segment 222 extending from an end of the embedded segment 221 to insert into the insertion slot 13, and a soldering segment 223 that extends from another end of the embedded segment 221 to pass through the accommodating slot 14. In addition, any one of the conductive terminals 22 can be defined as a signal terminal, a ground terminal, or a power terminal according to functional requirements.

Figure 5:
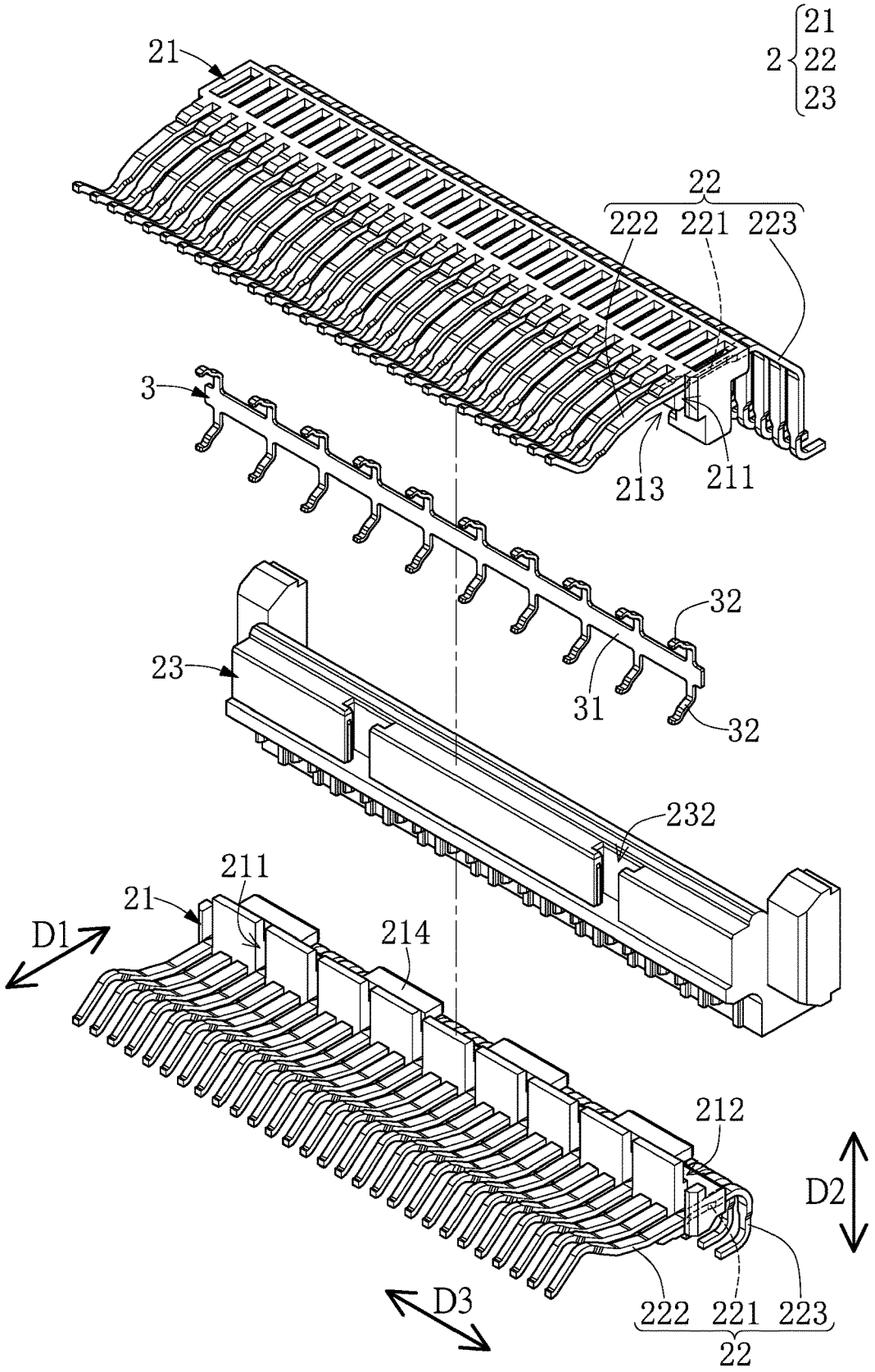
FIG. 5 is an exploded view showing a terminal module and a connection bridge of FIG. 3.
Figure 6:
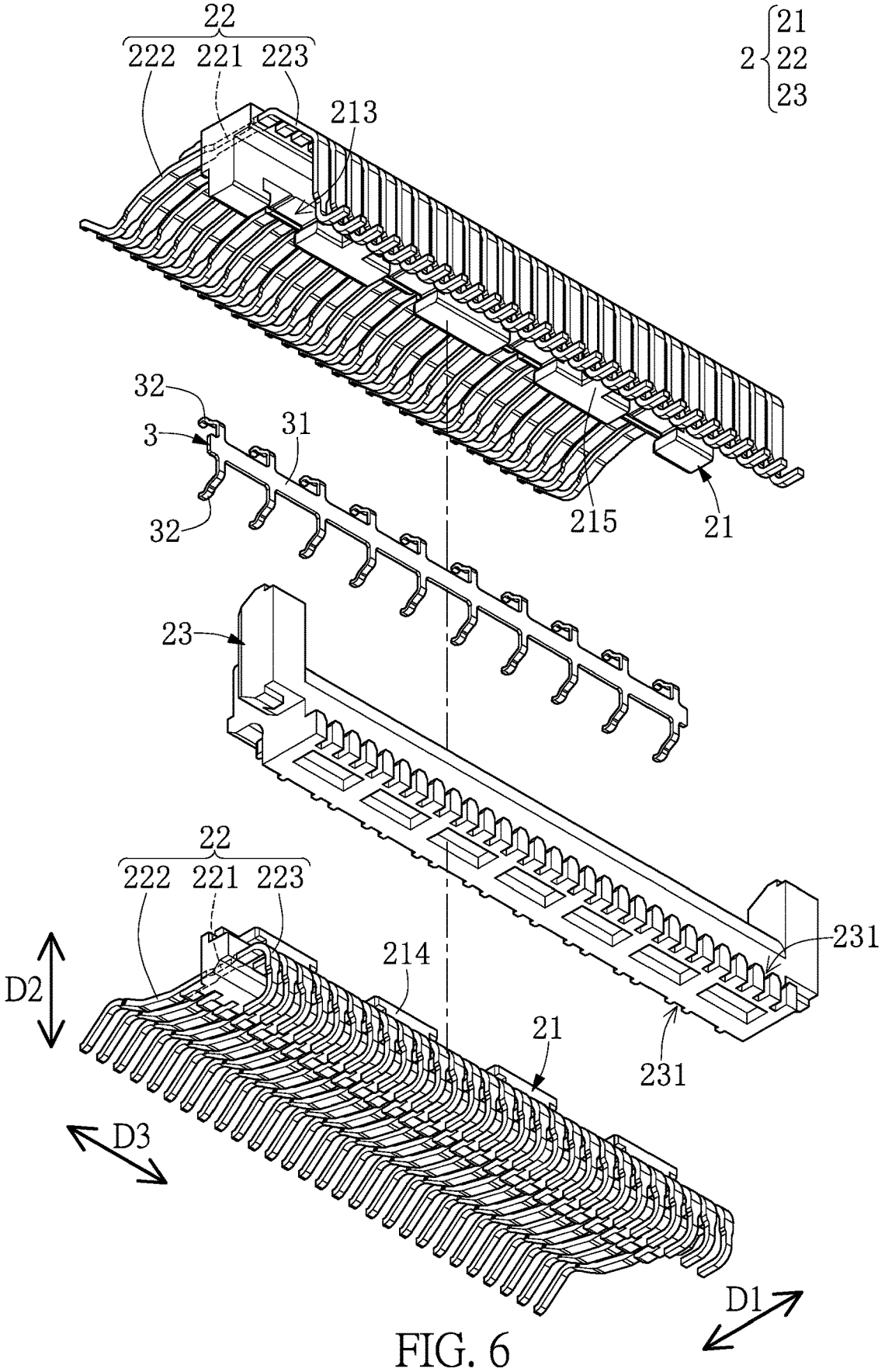
FIG. 6 is an exploded view showing the terminal module and the connection bridge of FIG. 4.

Specifically, the conductive terminals 22 of one of the two rows respectively correspond in position to the conductive terminals 22 of the other one of the two rows. Any one of the conductive terminals 22 fixed by the plastic core 21 having the transverse groove 212 has a length that is smaller than a length of any one of the conductive terminals 22 fixed by the other plastic core 21. In other words, two of the conductive terminals 22 corresponding in position to each other have different lengths that are caused by the soldering segments 223 thereof. For example, as shown in FIG. 5, the conductive terminal 22 fixed by one of the two plastic cores 21 (e.g., the plastic core 21 shown in FIG. 5 arranged above the terminal comb 23 or formed without the transverse groove 212) has a length that is greater than a length of the conductive terminal 22 fixed by the other one of the two plastic cores 21 (e.g., the plastic core 21 shown in FIG. 5 arranged under the terminal comb 23 or having the transverse groove 212).

The terminal comb 23 has a plurality of terminal channels 231 formed in different sides thereof. The two plastic cores 21 are assembled with each other, the terminal comb 23 and one of the two plastic cores 21 (e.g., the plastic core 21 formed without the transverse groove 212) are restricted in position by being linearly slidable with each other along the second direction D2, and each of the terminal channels 231 is configured to accommodate at least one of the conductive terminals 22.

In other words, the solder segments 223 of the conductive terminals 22 of one of the two rows are disposed on one side of the terminal comb 23 and are fixed in the corresponding terminal channels 231, and the solder segments 223 of the conductive terminals 22 of the other one of the two rows are disposed on another side of the terminal comb 23 and are fixed in the corresponding terminal channels 231. Specifically, in the conductive terminal 22 having a longer length, the soldering segment 223 extends from the embedded segment 221 to cross over the terminal comb 23.

In the present embodiment, the terminal comb 23 and the corresponding plastic core 21 can have engagement structures in cooperation with each other, so that the terminal comb 23 and the corresponding plastic core 21 can be assembled with each other along the second direction D2. Specifically, the terminal comb 23 and one of the two plastic cores 21 have a plurality of second dovetail slots 232 and a plurality of second dovetail tenons 215 that are respectively inserted into the second dovetail slots 232, and are slidably assembled with each other along the second direction D2 by the second dovetail tenons 215 and the second dovetail slots 232. In other words, the second dovetail slots 232 and the second dovetail tenons 215 can be defined as the engagement structures of the terminal comb 23 and the corresponding plastic core 21. Moreover, in the present embodiment, one of the two plastic cores 21 has a plurality of second dovetail tenons 215, and the terminal comb 23 has a plurality of second dovetail slots 232 respectively in cooperation with the second dovetail tenons 215, but the present disclosure is not limited thereto.

For example, in other embodiments of the present disclosure, the terminal comb 23 and one of the two plastic cores 21 each have a plurality of second dovetail slots 232 and a plurality of second dovetail tenons 215 that are respectively inserted into the second dovetail slots 232. In other words, the second dovetail slots 232 and the second dovetail tenons 215 of one of the two plastic cores 21 are in cooperation with the second dovetail slots 232 and the second dovetail tenons 215 of the terminal comb 23. In addition, the plastic core 21 can have a plurality of second dovetail slots 232, and the terminal comb 23 can have a plurality of second dovetail tenons 215 that are respectively inserted into the second dovetail slots 232.

Figure 7:
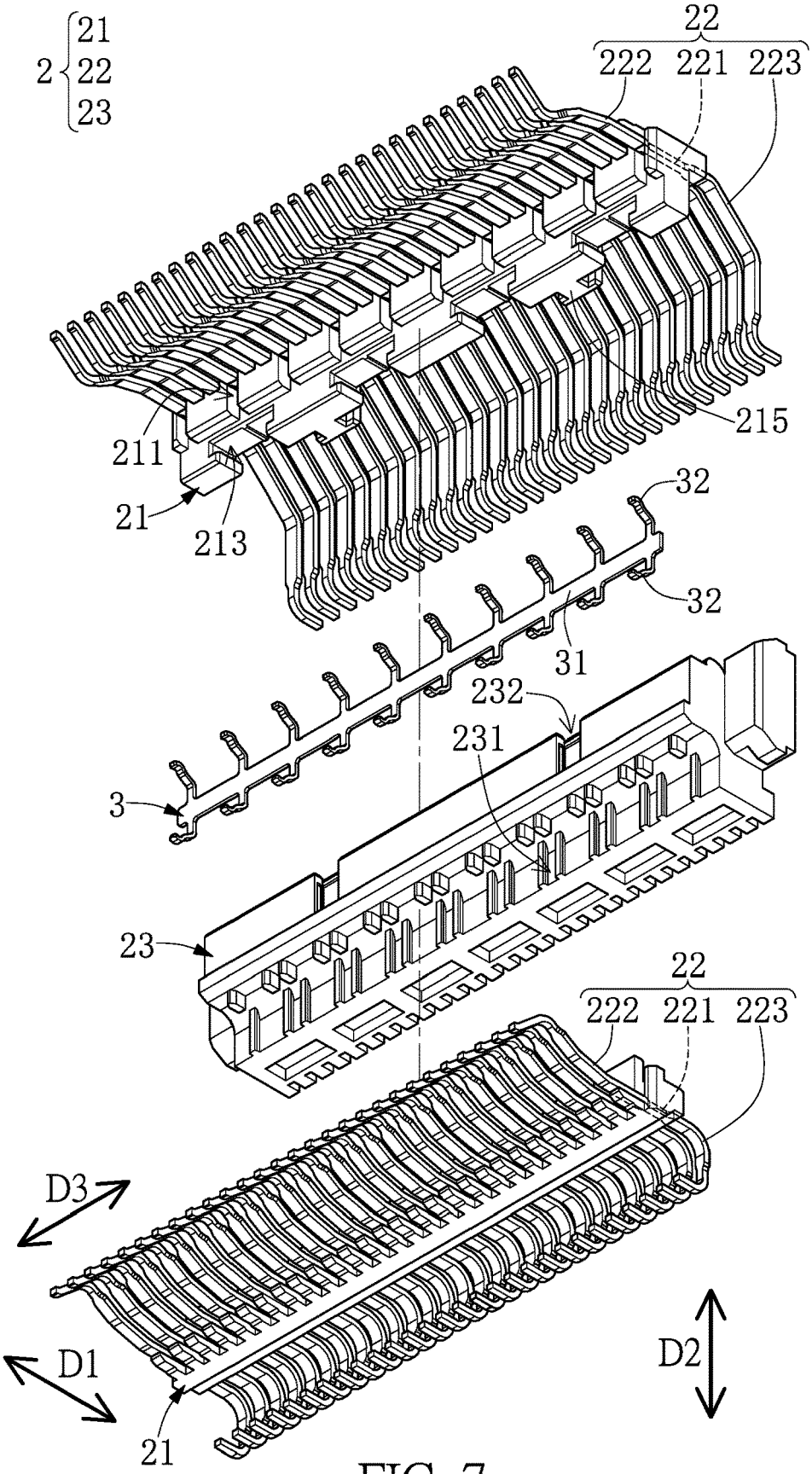
FIG. 7 is an exploded view showing the terminal module and the connection bridge from another angle of view.

Moreover, the terminal comb 23 and one of the two plastic cores 21 are assembled with each other, the second dovetail tenons 215 are arranged on one side of the corresponding plastic core 21 away from the troughs 211 (e.g., the right side of the troughs 211 of the plastic core 21 shown in FIG. 7 arranged above the terminal comb 23 or formed without the transverse groove 212), and the second dovetail slots 232 are arranged on one side of the terminal comb 23 that has the terminal channels 231 (e.g., the terminal channels 231 provided for the conductive terminals 22 that are fixed to the plastic core 21 having the transverse groove 212) arranged adjacent to the corresponding plastic core 21 (e.g., the plastic core 21 shown in FIG. 7 arranged under the terminal comb 23 or having the transverse groove 212).

In addition, the two plastic cores 21 in the present embodiment are abutted against the terminal comb 23 along the first direction D1, and the terminal comb 23 and the two plastic cores 21 are jointly assembled into the accommodating slot 14 of the insulating housing 1 along the first direction D1, so that the two plastic cores 21 are jointly sandwiched between the insulating housing 1 and the terminal comb 23. In other words, each of the two plastic cores 21 is received in the accommodating slot 14 of the insulating housing 1, and at least part of the terminal comb 23 is received in the accommodating slot 14 of the insulating housing 1.

Specifically, the accommodating slot 14 of the insulating housing 1 and one of the two plastic cores 21 are in an interference fit, and the terminal comb 23 and the accommodating slot 14 of the insulating housing 1 are in an interference fit, so that the two plastic cores 21 and the terminal comb 23 can be firmly assembled into the accommodating slot 14 of the insulating housing 1, but the present disclosure is not limited thereto. For example, in other embodiments of the present disclosure, the terminal module 2 can be provided only by interference fitting the terminal comb 23 and the accommodating slot 14 of the insulating housing 1, and the insulating housing 1 and the terminal comb 23 are configured to clamp the two plastic cores 21, thereby fixing the above components of the terminal module 2.

The connection bridge 3 is arranged between the two rows of the conductive terminals 22 respectively fixed by the two plastic cores 21, and the connection bridge 3 has at least two elastic arms 32 respectively abutted against at least two of the conductive terminals 22 that are respectively fixed by the two plastic cores 21. In the present embodiment, the conductive terminals 22 abutted against the elastic arms 32 of the connection bridge 3 are used as ground terminals, thereby electrically coupling at least two conductive terminals 22 (e.g., the ground terminals) respectively arranged in different rows.

In the present embodiment, the connection bridge 3 is integrally formed as a one piece structure, and includes a transverse beam 31 and the at least two elastic arms 32 that respectively extend from two opposite sides of the transverse beam 31. The quantity of the elastic arm 32 extending from any one of the two sides of the transverse beam 31 is more than one. Specifically, the transverse beam 31 is in a strip-shape parallel to the third direction D3, and the elastic arms 32 respectively extend from two long edges of the transverse beam 31 (e.g., the top edge and the bottom edge of the transverse beam 31 shown in FIG. 7) toward the same side and away from each other.

In the present embodiment, the elastic arms 32 connected to one of the two long edges of the transverse beam 31 are spaced apart from each other by equal intervals, and respectively face toward the elastic arms 32 connected to the other one of the two long edges of the transverse beam 31 along the second direction D2. The quantity of the elastic arms 32 of the connection bridge 3 in the present embodiment is equal to the quantity of the ground terminals of the terminal module 2 defined by the conductive terminals 22.

In addition, the transverse beam 31 of the connection bridge 3 is arranged in the transverse groove 212 and is sandwiched between the two plastic cores 21, and the elastic arms 32 of the connection bridge 3 are respectively arranged in the troughs 211 of the two plastic cores 21. Each of the elastic arms 32 of the connection bridge 3 is restricted in one of the troughs 211 of the corresponding plastic core 21 by being linearly slidable, and is configured to be linearly slidable along the second direction D2.

Moreover, the elastic arms 32 of the connection bridge 3 are respectively abutted against all ground terminals of the terminal module 2 defined by the conductive terminals 22, thereby achieving a common ground effect and improving high-frequency performance of the card edge connector 100. Each of the elastic arms 32 is abutted against the embedded segment 221 of the corresponding conductive terminal 22 (or the ground terminal) that is supported by the corresponding plastic core 21, so that the connection between each of the elastic arms 32 and the corresponding embedded segment 221 can be effectively maintained.

It should be noted that the components of the card edge connector 100 (e.g., the insulating housing 1, the two plastic cores 21, the connection bridge 3, and the terminal comb 23) are assembled with each other along a single direction by the structural design thereof, thereby effectively increasing the assembling stability of the card edge connector 100. In addition, in other embodiments of the present disclosure, the card edge connector 100 can further include a metallic shield covering an outer surface of the insulating housing 1, thereby effectively increasing the structural strength of the card edge connector 100.

In conclusion, by virtue of "the card edge connector" in the present disclosure, the two plastic cores 21 are restricted in position by being linearly slidable with each other, the two plastic cores 21 are configured to be linearly slidable with each other along the first direction D1, the terminal comb 23 and one of the two plastic cores 21 are restricted in position by being linearly slidable with each other along the second direction D2, the accommodating slot 14 of the insulating housing 1 and one of the two plastic cores 21 are in an interference fit, and the terminal comb 23 and the accommodating slot 14 of the insulating housing 1 are in an interference fit, so that the two plastic cores 21 and the terminal comb 23 can be firmly assembled into the accommodating slot 14 of the insulating housing 1.

Moreover, by virtue of "the card edge connector" in the present disclosure, the connection bridge 3 is arranged between the two rows of the conductive terminals 22, and the at least two elastic arms 32 of the connection bridge 3 are respectively abutted against at least two of the conductive terminals 22 that respectively belong to the two rows, thereby electrically coupling at least two conductive terminals 22 (e.g., the ground terminals) respectively arranged in different rows.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A card edge connector, comprising:

an insulating housing including an insertion surface and an assembling surface, wherein the insulating housing has an insertion slot recessed in the insertion surface and an accommodating slot that is recessed in the assembling surface, and wherein the insertion slot is configured to accommodate an electronic card along a first direction that is defined as a direction from the insertion surface toward the assembling surface;

a terminal module including two plastic cores, a terminal comb, and a plurality of conductive terminals that are respectively fixed by the two plastic cores so as to be arranged in two rows, wherein the two plastic cores are restricted in position by being linearly slidable with each other along the first direction, and each of the two plastic cores is received in the accommodating slot of the insulating housing, and wherein surfaces of the terminal comb and one of the two plastic cores facing each other along the first direction have a plurality of engagement structures that are formed thereon along the first direction to be in cooperation with each other, so that the terminal comb and the one of the two plastic cores are assembled with each other along a second direction perpendicular to the first direction through the engagement structures; and a connection bridge arranged between the two rows of the conductive terminals respectively fixed by the two plastic cores, wherein the connection bridge has at least two elastic arms respectively abutted against at least two of the conductive terminals that are respectively fixed by the two plastic cores.

2. The card edge connector according to claim 1, wherein the terminal comb is abutted against the two plastic cores, at least part of the terminal comb is received in the accommodating slot of the insulating housing, and the terminal comb and the accommodating slot are in an interference fit.

3. The card edge connector according to claim 1, wherein the two plastic cores have a plurality of first dovetail slots and a plurality of first dovetail tenons that are respectively inserted into the first dovetail slots, and wherein the two plastic cores are slidably assembled with each other along the first direction by the first dovetail tenons and the first dovetail slots.

4. The card edge connector according to claim 1, wherein each of the two plastic cores has a plurality of troughs each extending along the second direction, and wherein each of the at least two elastic arms of the connection bridge is restricted in one of the troughs of the corresponding plastic core by being linearly slidable, and is configured to be linearly slidable along the second direction.

5. The card edge connector according to claim 2, wherein the terminal comb and the one of the two plastic cores are restricted in position by being linearly slidable with each other.

6. The card edge connector according to claim 3, wherein the engagement structures of the terminal comb and the one of the two plastic cores have a plurality of second dovetail slots and a plurality of second dovetail tenons that are respectively inserted into the second dovetail slots, and are slidably assembled with each other along the second direction by the second dovetail tenons and the second dovetail slots.

7. The card edge connector according to claim 2, wherein the two plastic cores are abutted against the terminal comb along the first direction, the terminal comb and the two plastic cores are jointly assembled into the accommodating slot of the insulating housing along the first direction, and the two plastic cores are jointly sandwiched between the insulating housing and the terminal comb.

8. The card edge connector according to claim 1, wherein the at least two elastic arms respectively extend from two opposite sides of a transverse beam of the connection bridge, and the quantity of the elastic arm extending from any one of the two sides of the transverse beam is more than one.

9. The card edge connector according to claim 1, wherein the accommodating slot of the insulating housing and one of the two plastic cores are in an interference fit.

10. The card edge connector according to claim 1, wherein each of the conductive terminals includes an embedded segment embedded in the corresponding plastic core, a contact segment extending from an end of the embedded segment to insert into the insertion slot, and a soldering segment that extends from another end of the embedded segment to pass through the accommodating slot.

11. The card edge connector according to claim 1, wherein the conductive terminals of one of the two rows respectively correspond in position to the conductive terminals of the other one of the two rows, and any two of the conductive terminals respectively belonging to the two rows and corresponding in position to each other have different lengths.

12. The card edge connector according to claim 1, wherein the connection bridge includes a transverse beam, one of the two plastic cores has a transverse groove, and the transverse beam of the connection bridge is arranged in the transverse groove and is sandwiched between the two plastic cores.

13. A card edge connector, comprising:

an insulating housing including an insertion surface and an assembling surface, wherein the insulating housing has an insertion slot recessed in the insertion surface and an accommodating slot that is recessed in the assembling surface, and wherein the insertion slot is configured to accommodate an electronic card along a first direction that is defined a direction from the insertion surface toward the assembling surface;

a terminal module including two plastic cores, a terminal comb, and a plurality of conductive terminals that are respectively fixed by the two plastic cores so as to be arranged in two rows, wherein the two plastic cores are restricted in position by being linearly slidable with each other along the first direction, and each of the two plastic cores is received in the accommodating slot of the insulating housing, and wherein the terminal comb and one of the two plastic cores have a plurality of engagement structures in cooperation with each other, so that the terminal comb and the one of the two plastic cores are assembled with each other through the engagement structures; and a connection bridge arranged between the two rows of the conductive terminals respectively fixed by the two plastic cores, wherein the connection bridge has at least two elastic arms respectively abutted against at least two of the conductive terminals that are respectively fixed by the two plastic cores, and two opposite sides of the connection bridge are sandwiched between and abutted against the two plastic cores along the first direction.

* * * * *